US008251453B2

(12) United States Patent
Chen

(10) Patent No.: US 8,251,453 B2
(45) Date of Patent: Aug. 28, 2012

(54) ADJUSTABLE ARMREST SUPPORT OF CHAIR

(76) Inventor: Chao-Ken Chen, Changhua County (TW)

( * ) Notice: Subject to any disclaimer, the term of this patent is extended or adjusted under 35 U.S.C. 154(b) by 16 days.

(21) Appl. No.: 12/955,942

(22) Filed: Nov. 30, 2010

(65) Prior Publication Data

US 2012/0098318 A1 Apr. 26, 2012

(51) Int. Cl.
*A47C 7/54* (2006.01)

(52) U.S. Cl. ..... 297/411.36

(58) Field of Classification Search ..... 297/411.2, 297/411.35, 411.36; 248/118.3
See application file for complete search history.

(56) References Cited

U.S. PATENT DOCUMENTS 5,388,892 A * 2/1995 Tornero ..... 297/411.36
6,209,840 B1 * 4/2001 Chen ..... 248/407
6,419,323 B1 * 7/2002 Chu et al. ..... 297/411.36
7,156,466 B1 * 1/2007 Chang ..... 297/411.36
7,556,316 B1 * 7/2009 Lai ..... 297/411.36
2006/0250018 A1 * 11/2006 Tsai ..... 297/411.36
2008/0309140 A1 * 12/2008 Ho ..... 297/411.36
2011/0248542 A1 * 10/2011 Tsai ..... 297/411.36

* cited by examiner

*Primary Examiner* — Milton Nelson, Jr.

(57) ABSTRACT

The chair armrest support includes a hollow upper pillar for connecting an armrest and a lower pillar mounted on a chair. The lower pillar penetrates into the upper pillar for form a slidable connection. The lower pillar includes a main body, a sleeve, a positioning board, a T-shaped frame and a linking board. The main body has a hollow portion accommodating the positioning board, T-shaped frame and linking board. The main body is put in the sleeve. There is a positioning slot in the positioning board. A vertical portion of the T-shaped frame penetrates in the main body, and a horizontal portion is fixed atop the upper pillar. A spring is disposed between the horizontal portion and linking board. The linking board is provided with an inclined hole corresponding to a limiting hole of the vertical portion. A bolt penetrates the limiting hole, positioning slot and inclined hole. A handle beside the upper pillar is fixed to the linking board.

7 Claims, 8 Drawing Sheets

ADJUSTABLE ARMREST SUPPORT OF CHAIR

BACKGROUND OF THE INVENTION

1. Technical Field

The invention relates to chairs, particularly to supports for armrests of chairs.

2. Related Art

Chairs must be used by everyone every day. Especially, those people who work in offices need to sit on chairs almost all day long. Quality of chairs directly affects feeling of the users. Due to the differences of users' somatotype and habit, besides height adjustment of the cushion, height adjustable armrests are progressively popular in office chairs.

U.S. patent application Nos. 2009/0087251 and 2008/0156962, which were also filed by the inventor of this application, provide two adjustable armrest support structures (hereinafter "'251" and "'962"). These two structures must employ a thumbscrew to position the armrest which has been just adjusted. It is so inconvenient to users. An automatic positioning mechanism will be much more convenient than the conventional such as '251 and '962.

SUMMARY OF THE INVENTION

An object of the invention is to provide an adjustable armrest support of chair, which can automatically position the height of armrest without using any screws.

To accomplish the above object, the invention includes a hollow upper pillar for connecting an armrest and a lower pillar mounted on a chair. The lower pillar penetrates into the upper pillar for form a slidable connection. The lower pillar includes a main body, a sleeve, a positioning board, a T-shaped frame and a linking board. The main body has a hollow portion accommodating the positioning board, T-shaped frame and linking board. The main body is put in the sleeve. There is a positioning slot in the positioning board. A vertical portion of the T-shaped frame penetrates in the main body, and a horizontal portion is fixed atop the upper pillar. A spring is disposed between the horizontal portion and linking board. The linking board is provided with an inclined hole corresponding to a limiting hole of the vertical portion. A bolt penetrates the limiting hole, positioning slot and inclined hole. A handle beside the upper pillar is fixed to the linking board.

DETAILED DESCRIPTION OF THE INVENTION

Figure 1:
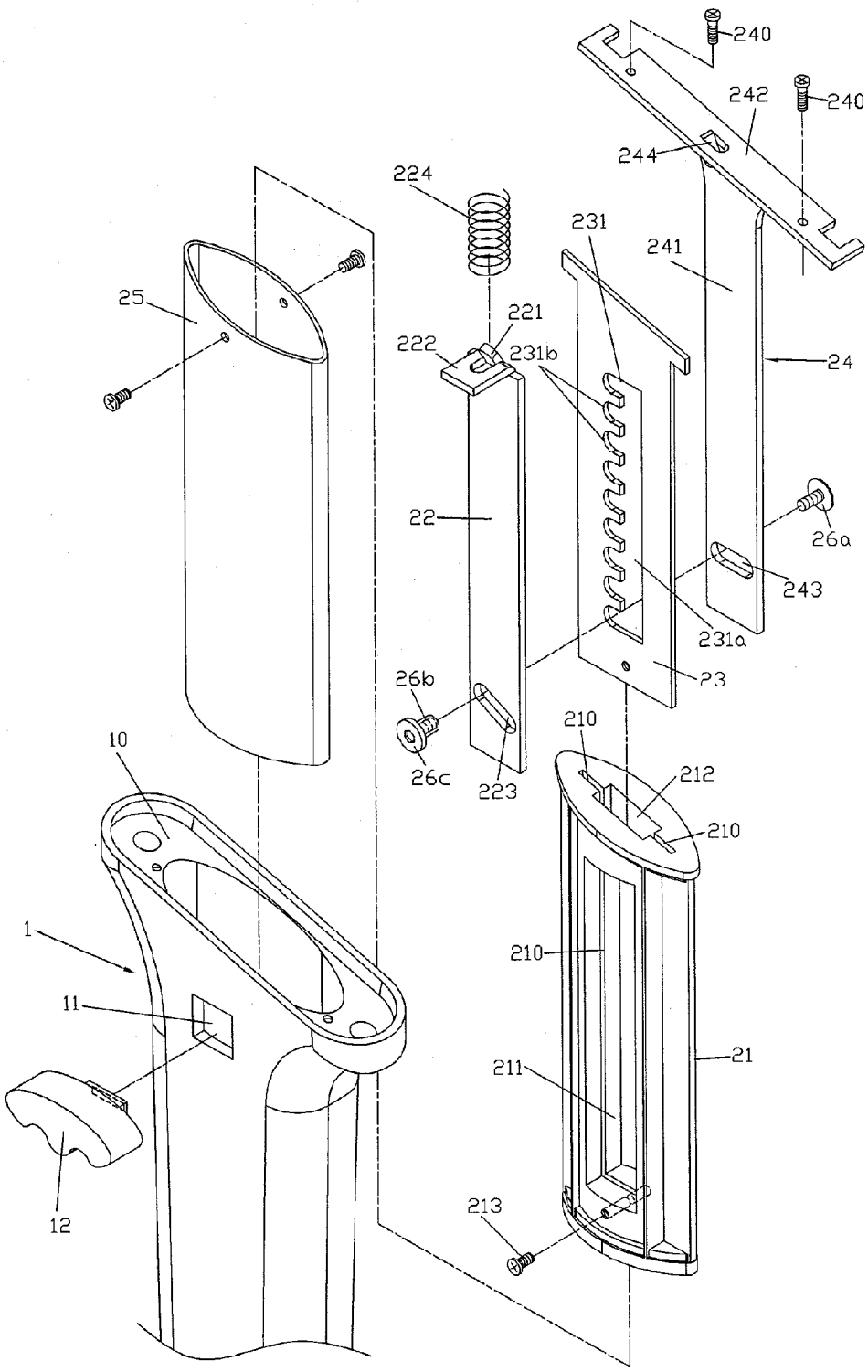
FIG. 1 is an exploded perspective view of the invention.
Figure 2:
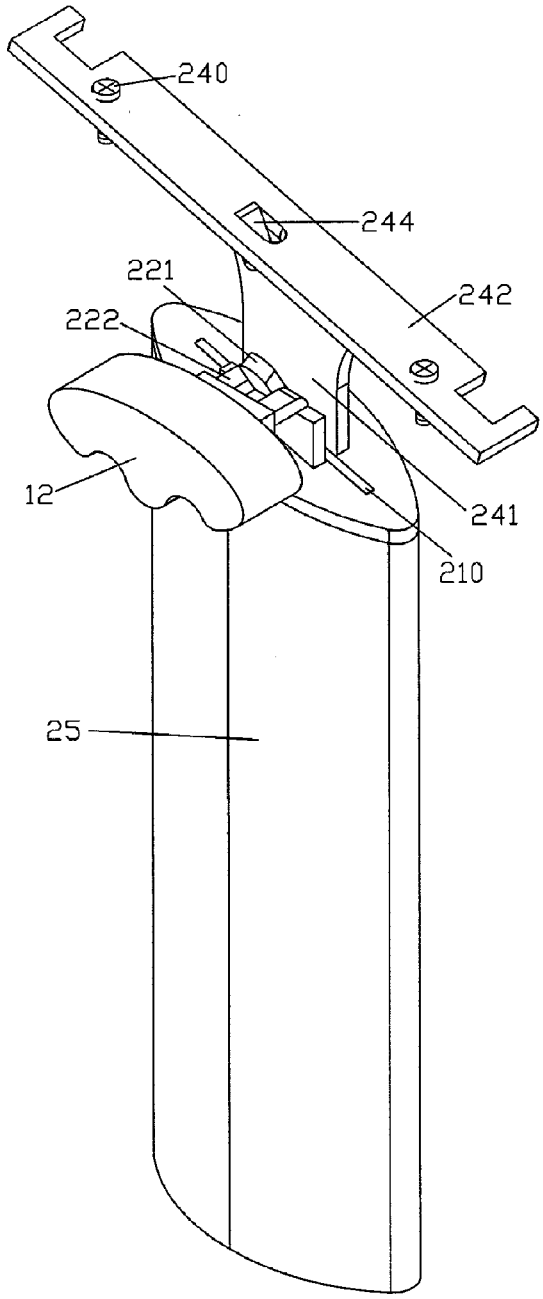
FIG. 2 is an assembled perspective view of the invention.
Figure 3:
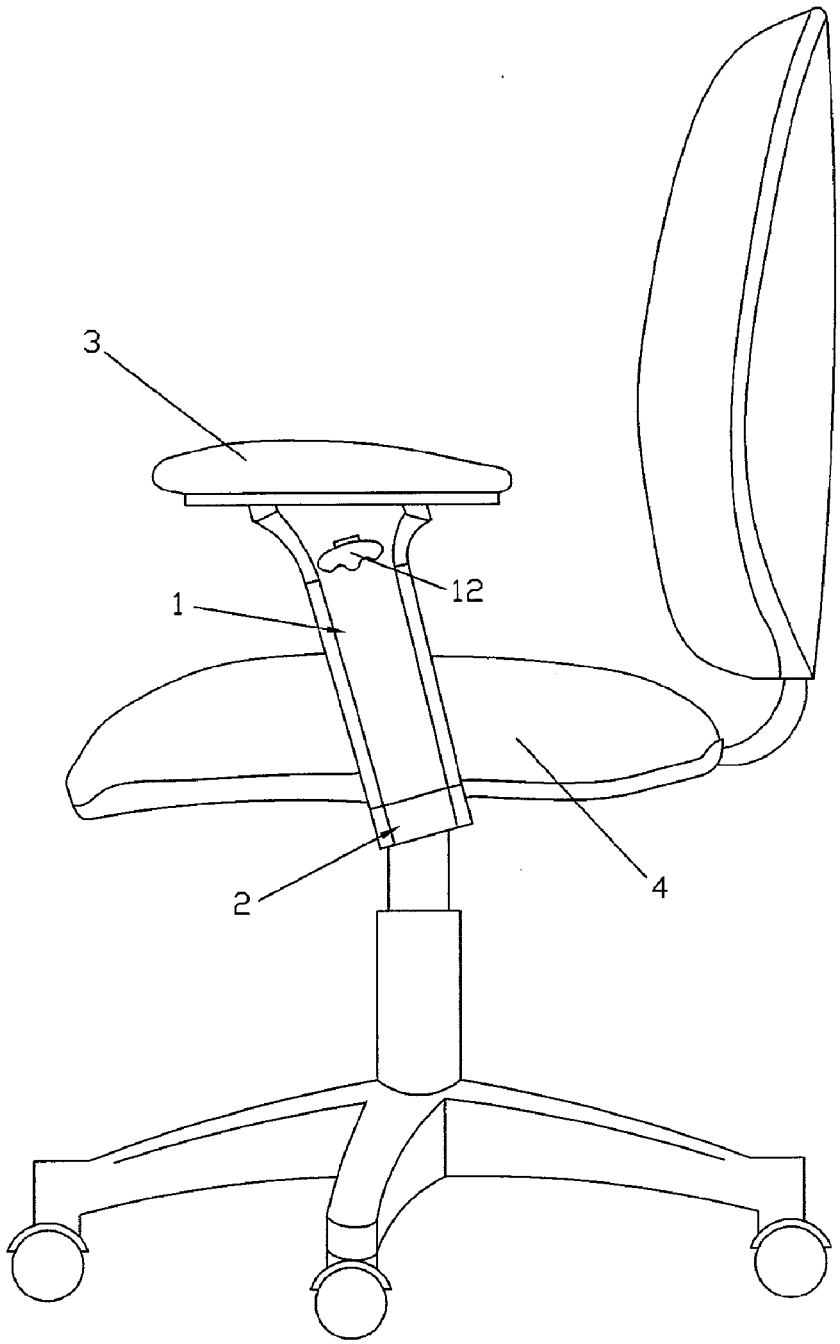
FIG. 3 is schematic view showing the invention applied in a chair.

Please refer to FIGS. 1-3. The adjustable armrest support of the invention includes a hollow upper pillar 1 for connecting an armrest and a lower pillar 2 mounted on a chair. The lower pillar 2 penetrates into the upper pillar 1 to form a slidable connection. The lower pillar 2 includes a main body 21, a sleeve 25, a positioning board 23, a T-shaped frame 24 and a linking board 22. The main body 21 has a hollow portion 211 and a trough 212 which corresponds to the positioning board 23, T-shaped frame 24 and linking board 22 and communicates with the hollow portion 211. The positioning board 23, T-shaped frame 24 and linking board 22 penetrate into the hollow portion 211 via the trough 212 and the positioning board 23 is sandwiched between the T-shaped frame 24 and linking board 22.

The linking board 22 is of an inverted-L shape. The top of the linking board 22 is provided with a first hook 221 for hooking an end of a compression spring 224. An inclined hole 223 is disposed at the bottom of the linking board 22. There is a longitudinal positioning slot 231 in the positioning board 23. The positioning slot 231 is like a comb in shape and composed of a straight through hole 231*a* and a plurality of semicircular holes 231*b* arranged in a row. The T-shaped frame 24 is composed of a vertical portion 241 and a horizontal portion 242. A transversal limiting hole 243 is disposed at the bottom of the vertical portion 241. The limiting hole 243 is positionally corresponding to the positioning slot 231 and inclined hole 223 so that they can be penetrated by a bolt 26 composed of a screw 26*a* and nut 26*b*. The nut 26*b* has a head 26*c*. The horizontal portion 242 of the T-shaped frame 24 is provided with a second hook 244 for hooking the other end of the compression spring 224. In other words, the compression spring 224 is located between the horizontal portion 242 of the T-shaped frame 24 and the linking board 22 and normally exerts a downward force on the linking board 22.

The main body 21 associated with the linking board 22, positioning board 23 and T-shaped frame 24 is put in the sleeve 25. The positioning board 23 is fastened to the main body 21 by a screw 213. The horizontal portion 242 of the T-shaped frame 24 is fastened to the top 10 of the upper pillar 1, i.e. the upper pillar 1 will move with the T-shaped frame 24. A lateral side of the upper pillar 1 is provided with a through hole 11 corresponding to the top 222 of the linking board 22 for being passed through by the top 222 and allowing the top 222 to move therein. A handle 12 is mounted on the top 222 for allowing a user to hold to pull up the linking board 22.

Figure 4:
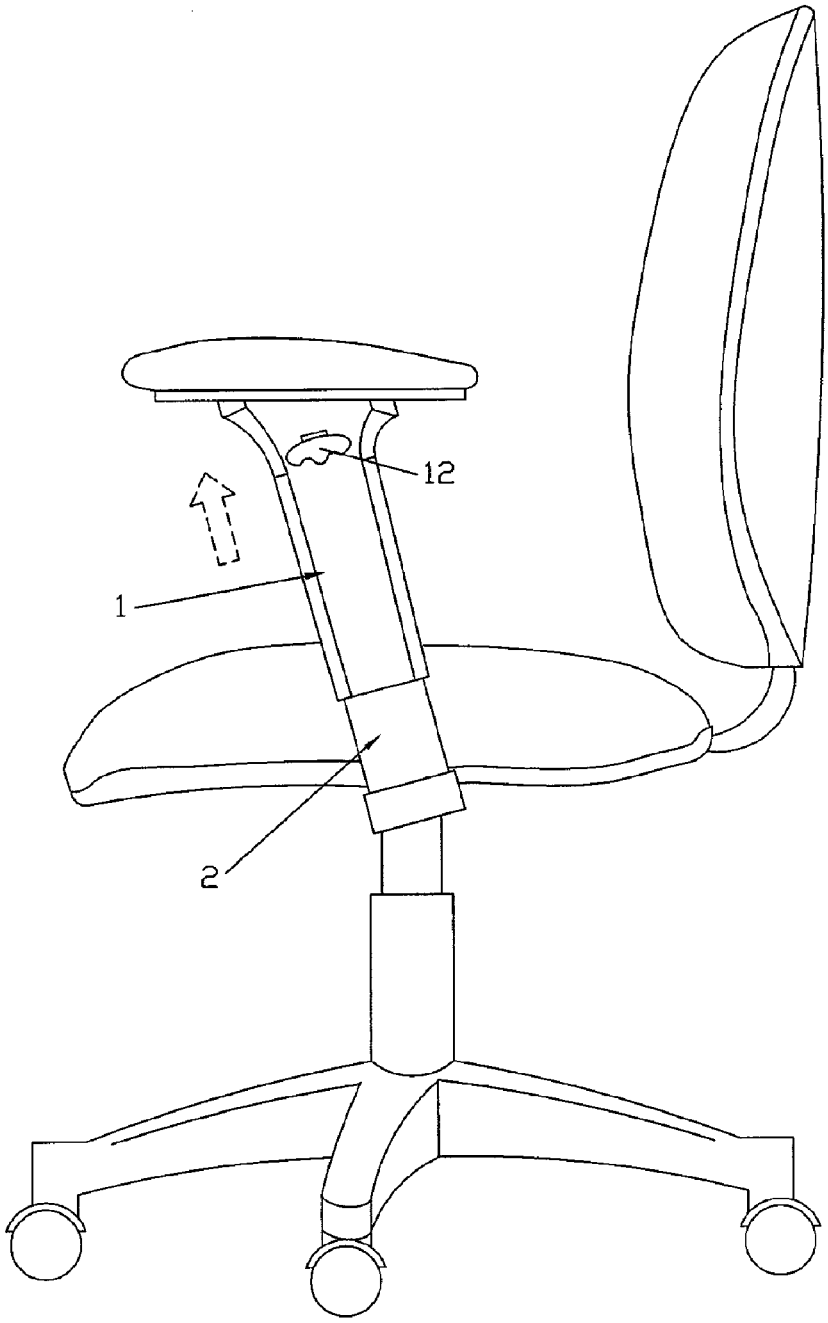
FIG. 4 is a schematic view showing the height adjustment of FIG. 3.

FIG. 3 is a schematic view showing the invention is applied in a chair for supporting an armrest 3. The armrest 3 is fixed atop the upper pillar 1 and the lower pillar 2 is mounted on a cushion 4. The armrest 3 can be adjusted upwards and downwards by sliding the upper pillar 1 as shown in FIG. 4.

Figure 5:
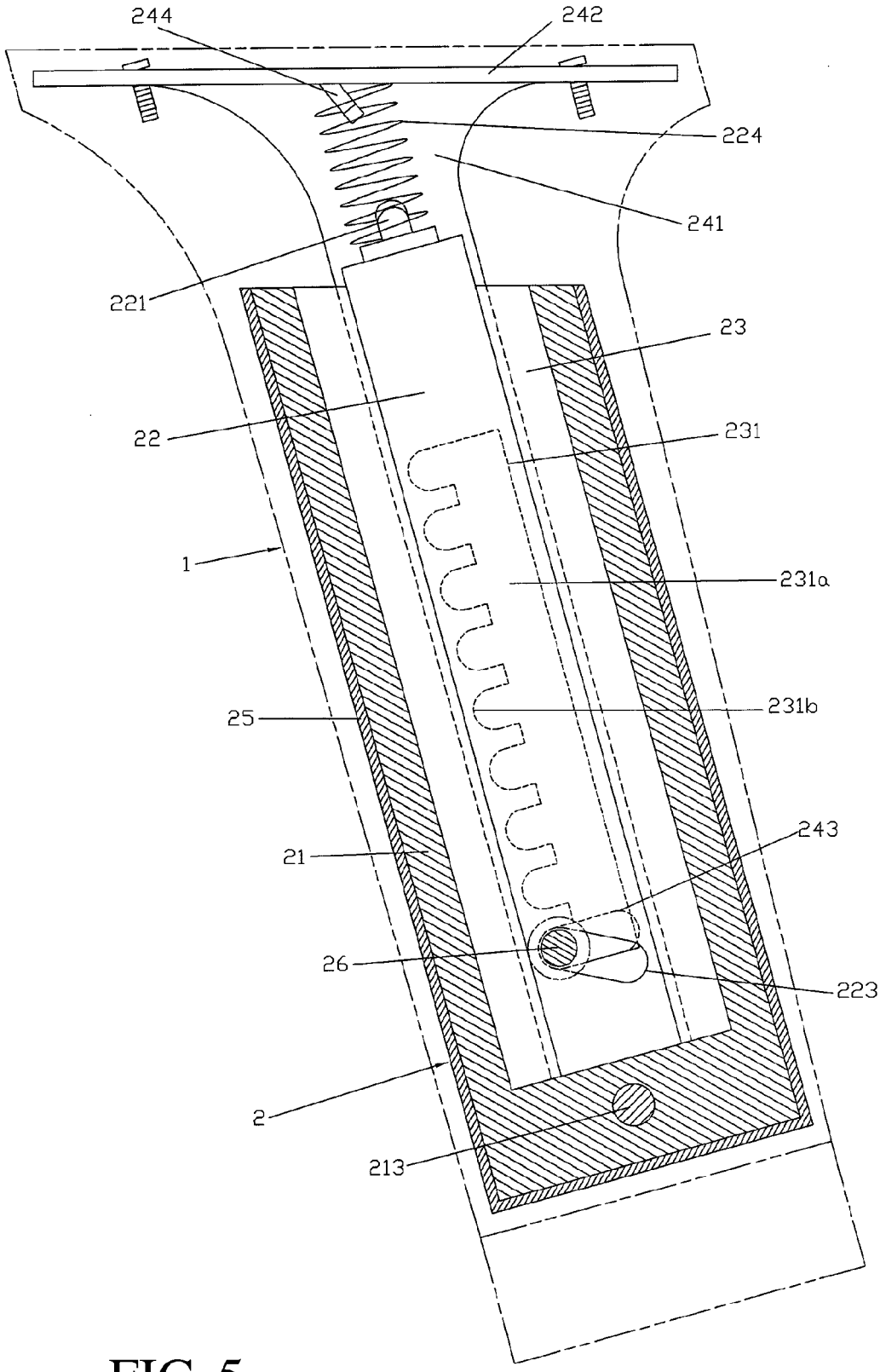
FIGS. 5-8 are sectional views showing different statuses when the height is being adjusted.
Figure 6:
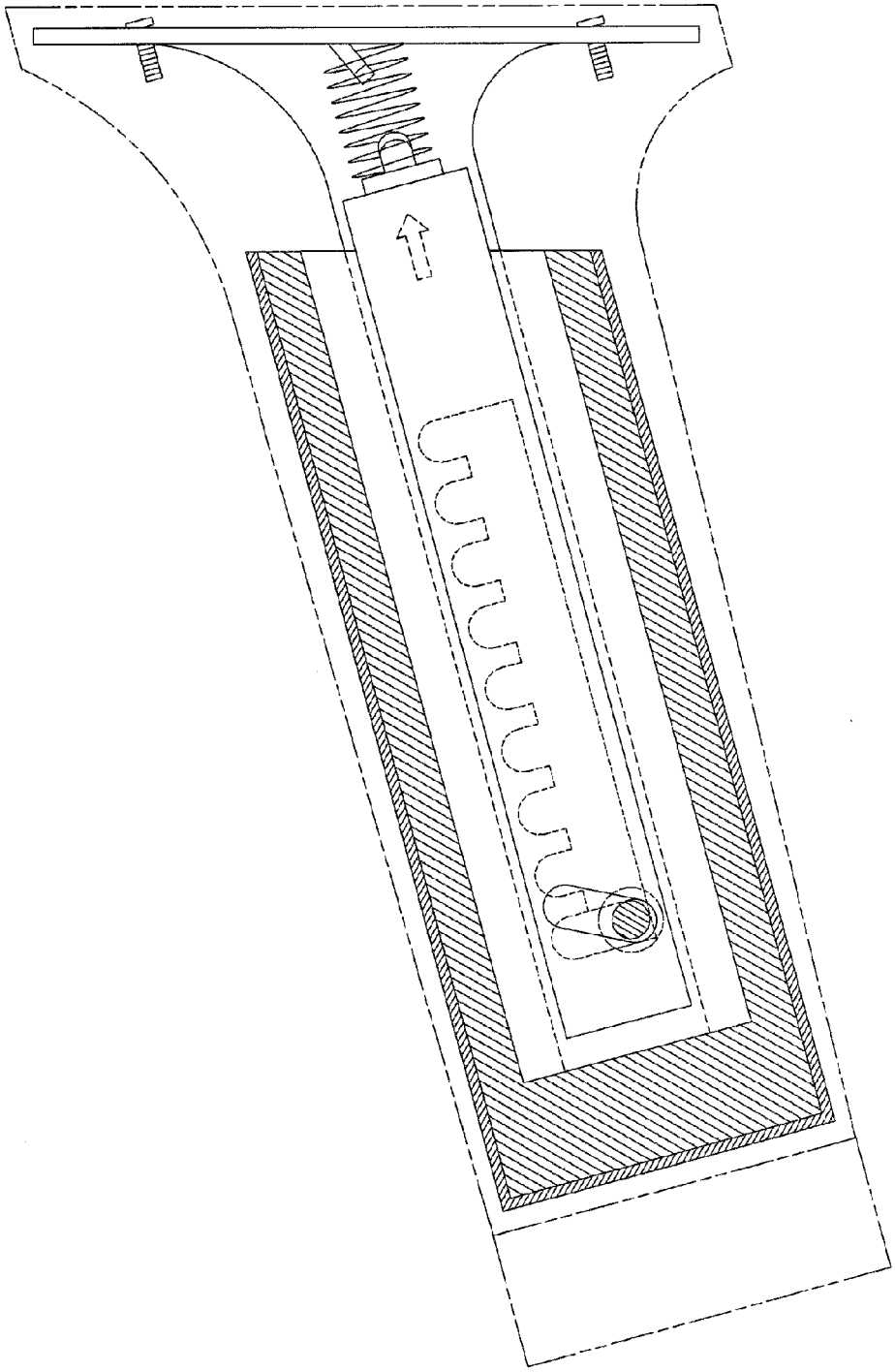
Figure 7:
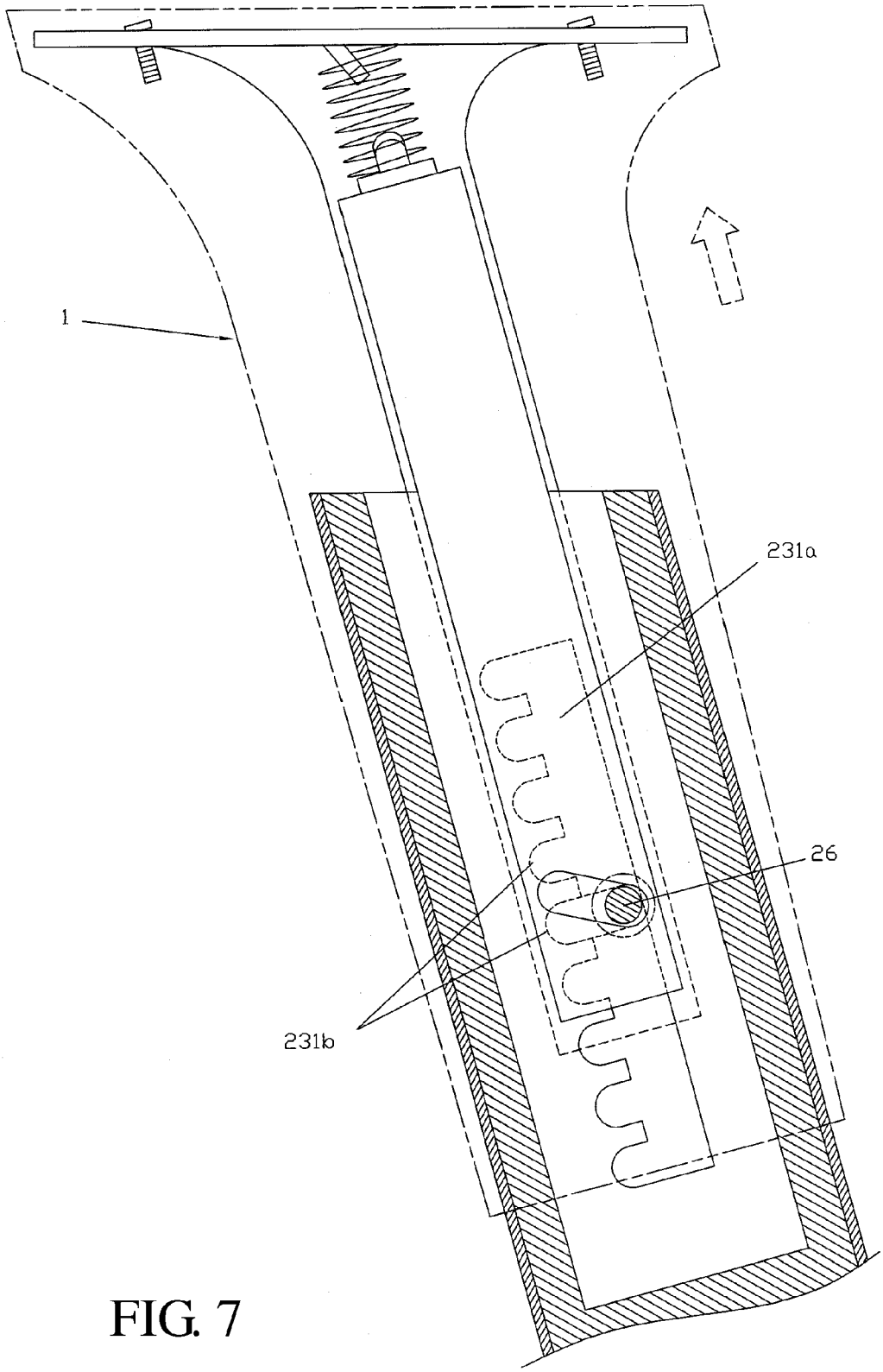
Figure 8:
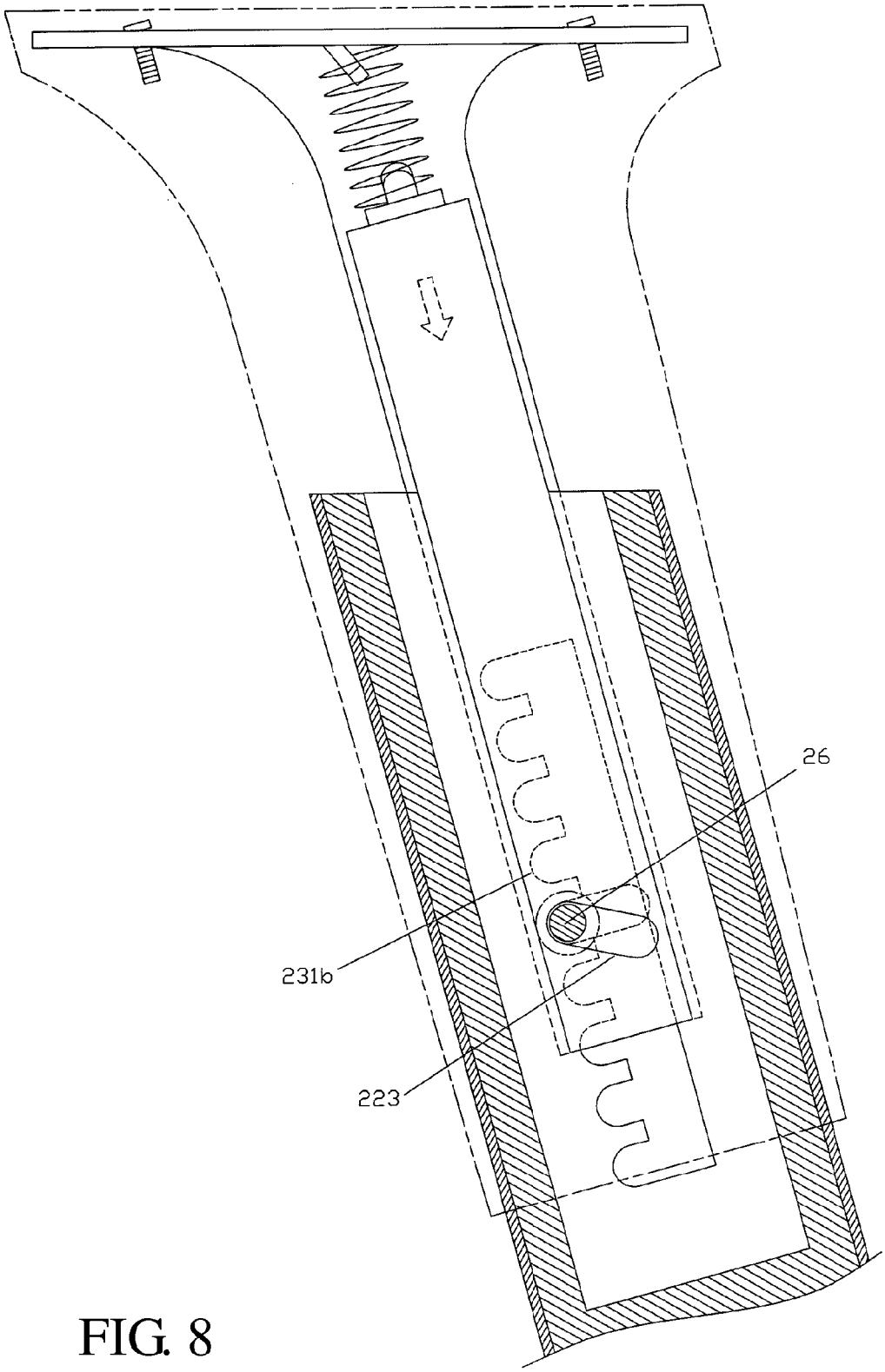

FIG. 5 is a longitudinal sectional view of the invention in a normal status. Under the status, and the handle 12 is not forced, the linking board 22 is pushed downwards by the compression spring 224, so the bolt 26 moves to the upper end of the inclined hole 223 to embed the bolt 26 into a semicircular hole 231*b*. At this time, the T-shaped frame 24 cannot move because its limiting hole 243 is blocked by the bolt 26, i.e. a positioning effect is formed. When a user pulls up the handle 12 as shown in FIG. 6, the compression spring 224 is further compressed, the linking board 22 moves upwards, and the bolt 26 is forced by the inclined hole 223 to move out of the semicircular hole 231*b* and to move transversally. At this time, the bolt 26 moves into the straight through hole 231*a* to be freely slidable. In other words, the upper pillar 1 and T-shaped frame 24 can be moved upwards or downwards to a desired position by moving the handle 12. That is, the height of the armrest is being adjusted as shown in FIG. 7. Finally, when the user releases the handle 12, the linking board 22 is pushed by the compression spring 224 to move downwards again, the bolt 26 is moved to the upper end of the inclined hole 223 to be embedded into another semicircular hole 231*b* as shown in FIG. 8. That is, a positioning effect is formed again but the bolt 26 is embedded into different semicircular hole 231*b*. By this, an automatic positioning function is achieved.

Those skilled in the art will appreciate that numerous changes and modifications can be made to the preferred embodiment of the invention, and that such changes and modifications can be made without departing from the spirit of the invention.

What is claimed is:

1. An adjustable armrest support of a chair; comprising:

a lower pillar for being connected to a cushion of the chair, comprising:

a positioning board, having a longitudinal positioning slot, wherein the positioning slot comprises a straight through hole and a plurality of semicircular holes arranged in a row and communicating with the straight through hole;

a linking board, being of an inverted-L shape, having a horizontal top, an inclined hole and a handle being mounted on the top;

a T-shaped frame composed of a vertical portion and a horizontal portion, the horizontal portion being provided with a transversal limiting hole positionally corresponding to the positioning slot and the inclined hole, and the hole, the positioning slot and the inclined hole being penetrated through by a bolt;

a compression spring disposed between the horizontal portion of the T-shaped frame and the top of the linking board for exerting a downward force on the linking board; and a main body having a hollow portion and a trough communicating therewith, the positioning board, the T-shaped frame and the linking board being accommodated in the hollow portion through the trough, and the positioning board is sandwiched between the T-shaped frame and the linking board; and an upper pillar for connecting an armrest, being hollow to slidably accommodate the lower pillar, one side of the upper pillar being provided with a through hole corresponding to the top of the linking board for allowing the top of the linking board to pass through and to be movable therein;

wherein the positioning board is fastened with the main body, the horizontal portion of the T-shaped frame is fastened atop the upper pillar; when the handle is not forced, the linking board is pushed by the compression spring to move downwards, and the bolt moves to an upper end of the inclined hole and enters a semicircular hole to form a position effect; when the handle is pulled up, the bolt moves to a lower end of the inclined hole and enters the straight through hole to form an adjustable effect.

2. The adjustable armrest support of claim 1, wherein the bolt comprises a screw and a nut.

3. The adjustable armrest support of claim 2, wherein the nut has a head.

4. The adjustable armrest support of claim 1, wherein the top of the linking board is provided with a first hook for hooking an end of the compression spring, and the horizontal portion of the T-shaped frame is provided with a second hook for hooking the other end of the compression spring.

5. The adjustable armrest support of claim 1, wherein the horizontal portion of the T-shaped frame is fastened to the upper pillar by a screw.

6. The adjustable armrest support of claim 1, wherein the positioning board is fastened to the main body by a screw.

7. The adjustable armrest support of claim 1, further comprising a sleeve covering the main body with the linking board, the positioning board and the T-shaped frame.

* * * * *